US005934896A

United States Patent [19]

Kwiatek

[11] Patent Number: 5,934,896

[45] Date of Patent: Aug. 10, 1999

[54] METHOD AND APPARATUS FOR GENERATING DUAL POINT TOP BURNER SPARK FOR GAS RANGE AND DUAL PORT BURNER INCORPORATING SAME

[75] Inventor: David J. Kwiatek, LaGrange, Ill.

[73] Assignee: Ranco of Delaware, Wilmington, Del.

[21] Appl. No.: 09/058,020

[22] Filed: Apr. 10, 1998

[51] Int. Cl.[6] ..... F23Q 3/00

[52] U.S. Cl. ..... 431/266; 431/264

[58] Field of Search ..... 431/266, 264

[56] References Cited

U.S. PATENT DOCUMENTS 3,730,672 5/1973 Berlincourt et al. ..... 431/264

*Primary Examiner*—Carroll B. Dority
*Attorney, Agent, or Firm*—Leydig, Voit & Mayer, Ltd.

[57] ABSTRACT

An ignition apparatus for a gaseous fuel burner having two areas of gaseous fuel discharge comprises a primary electrode positioned within a first area of gaseous fuel discharge and a secondary electrode having a first end positioned within the first area in close proximity to the primary electrode defining a jump gap, and a second end within a second area in proximity to the burner to form a ground spark gap. The burner has an outer and an inner periphery ignition area forming a torres shaped, or donut-like, burner separated by a gaseous fuel plenum through which the secondary electrode penetrates. The primary electrode may be mounted within the inner or outer periphery ignition area. A method of creating a dual point electric spark to ignite gaseous fuel at two separate areas within a dual port gas burner comprises grounding the burner, forming a series electric circuit which passes through the two separate ignition areas from a source of high voltage electric power to the burner, providing a jump gap within one of the separate ignition areas, and a ground spark gap in the other, and energizing the series electric circuit.

19 Claims, 6 Drawing Sheets

METHOD AND APPARATUS FOR GENERATING DUAL POINT TOP BURNER SPARK FOR GAS RANGE AND DUAL PORT BURNER INCORPORATING SAME

FIELD OF THE INVENTION

The instant invention relates to consumer appliances, and more particularly to gas ranges and methods for igniting gaseous fuel for use therein.

BACKGROUND OF THE INVENTION

Designers of consumer appliances, and specifically those involved with the design and manufacture of gas ranges, are constantly striving to improve the efficiency and reduce the cost of these designs. One such area of intense study involves the surface burners on consumer gas ranges. Specifically, the burner efficiency of heat transferred to the surface of the pan or skillet is of great interest. A typical burner assembly produces a plurality of individual flames resulting from the ignition of gaseous fuel ported from the burner assembly through a plurality of burner ports around the side periphery of the burner assembly. While this effectively transfers heat to the bottom cooking surface of the utensil, it does so in a point-wise ring fashion as a direct result of the type of flame produced thereby. This type of burner produces a plurality of individual hot spots on the bottom surface of the cooking utensil from which heat must be radiated to cook the food.

A burner design which seeks to improve the cooking efficiency of a gas range includes, in addition to the plurality of gaseous fuel ports on the outside periphery of the burner assembly, an interior donut hole area which also includes a plurality of gaseous fuel outlet ports. During the cooking operation, the gaseous fuel exiting the outlet ports around the outer periphery of the burner are ignited and provide heat to the bottom surface of the cooking utensil in much the same manner as a conventional burner. However, in addition to this area of heat transfer, this type of burner also allows flames to be generated within the donut hole portion in the center of the burner to allow heat to be transferred to the center bottom surface of the cooking utensil within the outer ring normally associated with output ports located on the outer periphery of the burner. While this burner design greatly increases the efficiency of the range top cooking, a problem exists with the ignition system for both areas of gaseous fuel flow.

Prior burner designs of this type have utilized separate spark ignition modules for each area of gaseous fuel release to ignite the gaseous fuel exiting the gaseous fuel ports in proximity thereto. However, in the highly priced competitive and cost sensitivity industry of consumer gas ranges, the inclusion of separate electronic ignition modules for both areas of gaseous fuel ignition unacceptable increases the cost of this component of the gas range. Other systems to resolve this problem have included crossover slots or other means for carrying a flame across the burner top from the outer periphery to the inner donut hole section to allow ignition of the gaseous fuel flowing therein. However, such a burner design also increases the cost of manufacture of these types of burners as well as reducing the reliability of ignition within the inner donut hole area due to contamination within the crossover slot.

SUMMARY OF THE INVENTION

It is therefore an object of the instant invention to overcome many of these and other problems existing in the art.

More specifically, it is an object of the instant invention to provide a new and useful means for igniting dual ignition areas on a surface gas burner for a gas range. Furthermore, it is an object of the instant invention to provide a means for igniting the gaseous fuel in dual areas of ignition which is highly reliable and which does not unacceptable increase the cost of manufacture of these range top burners. Moreover, it is an object of the instant invention to provide a means for igniting gaseous fuel in dual areas of ignition for a surface burner which may be utilized with either flame sensing or manual ignition. It is an additional object of the instant invention to provide a means of igniting gaseous fuel in dual areas of ignition which utilizes a single ignition circuit to ignite both areas of gaseous fuel flow. Moreover, it is an object of the instant invention to provide a means of igniting both areas of ignition utilizing electronic spark ignition technology. Additionally, it is an object of the instant invention to provide a means of ignition which has improved ignition characteristics.

In view of the above objects, it is a feature of the instant invention to provide a dual point sparking system utilizing a single electrode. It is a further feature of the instant invention that the dual point sparking system ensures equal magnitude of the resulting ignition spark. It is a further feature of the instant invention to provide a dual point sparking system which ensures nearly simultaneous generation of the equal magnitude ignition sparks. It is a further feature of the instant invention to provide the dual point sparking system utilizing a series coupled dual spark gap circuit. It is further a feature of the instant invention to provide such circuit having only one ground spark point and only one primary electrode. It is an additional feature of the instant invention to provide such circuit having a gas port in proximity to the electrode.

In a preferred embodiment of the instant invention, an ignition apparatus for a gaseous fuel burner which has a grounded housing and at least two areas of gaseous fuel discharge requiring ignition comprises a primary electrode coupled to an external source of high voltage electric power. This primary electrode is positioned within a first area of gaseous fuel discharge. A secondary electrode is also included having a first end thereof positioned within the first area in close proximity to the primary electrode and defining a jump gap therebetween. The second end is positioned within a second area of gaseous fuel discharge in proximity to the burner and forming a ground spark gap therebetween. Preferably, the ignition apparatus further comprises primary insulation which is operably coupled to the primary electrode and prevents inadvertent spark generation to the grounded burner housing. Secondary insulation is operably coupled to the secondary electrode and also prevents inadvertent spark generation to the grounded burner housing.

In a preferred embodiment of the instant invention, the burner is a dual port burner having an outer periphery ignition area and an inner periphery ignition area forming a torres shaped, donut-like burner. This outer periphery ignition area and the inner periphery ignition area are separated by a gaseous fuel plenum from which gaseous fuel is delivered to the outer periphery ignition area and the inner periphery ignition area. The secondary electrode penetrates through this gaseous fuel plenum, and the secondary insulation further prevents inadvertent spark generation within this gaseous fuel plenum. Preferably, the primary electrode is mounted within the inner periphery ignition area. Alternatively, the primary electrode is mounted within the outer periphery ignition area. In this later embodiment, the primary electrode may include a flame sense probe affixed thereto.

In an alternate preferred embodiment of the instant invention, a burner assembly for a gas range comprises a torres shaped burner base having an outer periphery and an inner periphery. This base is electrically coupled to an external electrical system ground. A torres shaped burner cap is positioned in relation to the burner base to form a gaseous fuel plenum therebetween, and to form at least one orifice in the fuel plenum positioned to deliver gaseous fuel to the outer periphery and at least one orifice in the fuel plenum positioned to deliver gaseous fuel to the inner periphery. A primary electrode is coupled to an external source of high voltage electric power, and positioned within a first area of gaseous fuel discharge. A secondary electrode having a first end thereof positioned within the first area in close proximity to the primary electrode defining a jump gap therebetween, and a second end thereof positioned within a second area of gaseous fuel discharge in proximity to the base and the cap forming a ground spark gap therebetween is also included.

This burner preferably further comprises primary insulation operably coupled to the primary electrode. This primary insulation prevents inadvertent spark generation to the base and to the cap. Secondary insulation is operably coupled to the secondary electrode also for preventing inadvertent spark generation to the base and to the cap. The secondary electrode penetrates through the gaseous fuel plenum, and the secondary insulation further prevents inadvertent spark generation within this gaseous fuel plenum. Preferably, this secondary insulation includes a gas flow port therein and at least one gas entry port allowing gaseous communication between the gaseous fuel plenum and the gas flow port. The exit of the gas flow port is in proximity to the secondary electrode so that the spark generated therefrom arcs through the gaseous fuel exiting therefrom. Preferably, the first area is defined within the inner periphery. Alternatively, the first area is defined by the base and the cap in proximity to the outer periphery. In this embodiment, the primary electrode may also include a flame sense probe affixed thereto.

In a highly preferred embodiment of the instant invention, the primary electrode, the jump gap, the secondary electrode, the ground spark gap, and the base and the cap form a series electric circuit from the external source of high voltage electric power to the external electrical system ground. This results in approximately simultaneous generation of a first spark at the jump gap and of a second spark at the ground spark gap, thereby resulting in ignition of gaseous fuel at the inner periphery and at the outer periphery, upon energization of the circuit.

A method of creating this dual point electric spark used to ignite gaseous fuel at two separate ignition areas within a dual port gas burner for a gas range comprises the steps of: a) grounding the burner to an electrical system ground; b) forming a series electric circuit from a source of high voltage electric power to the burner, the series electric circuit passing through the two separate ignition areas; c) providing a jump gap in the series electric circuit within one of the two separate ignition areas; d) providing a ground spark gap in the series electric circuit within the other of the two separate ignition areas; and e) energizing the series electric circuit.

In a preferred method of the instant invention, the step of forming a series electric circuit comprises the steps of: f) providing a primary electrode within a first ignition area; g) providing a secondary electrode having a first end thereof in the first ignition area and a second end in a second ignition area; h) positioning the first end of the secondary electrode in close proximity to the primary electrode creating a jump gap therebetween; and i) positioning the second end of the secondary electrode in proximity to the burner.

Therefore in accordance with an embodiment of the instant invention these and other aims, objectives, and features of the present invention will become more apparent from the following detailed description when taken in conjunction with the accompanying drawings.

DETAILED DESCRIPTION OF THE PREFERRED EMBODIMENT

Figure 1:
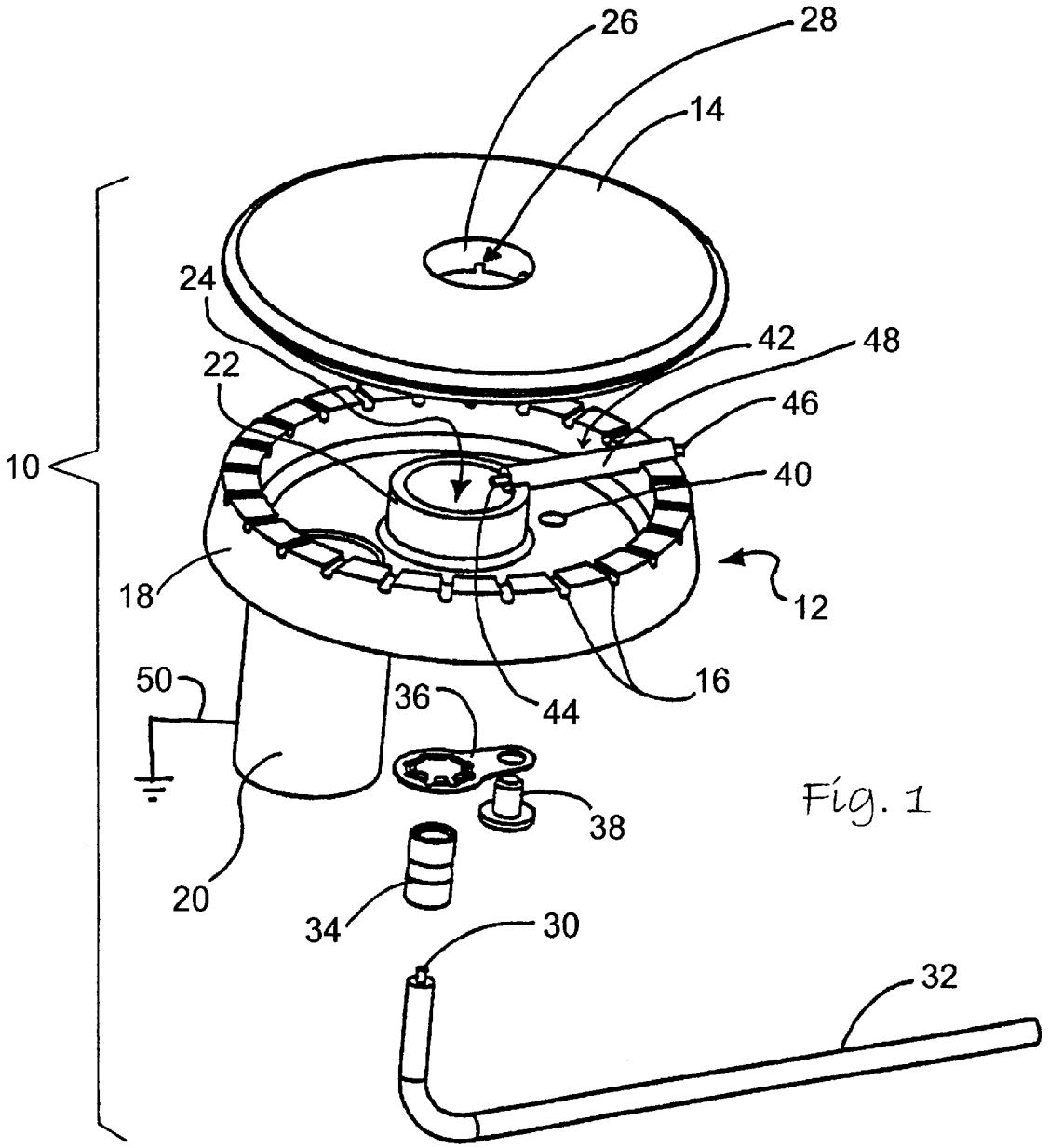
FIG. 1 is an exploded isometric view of an embodiment of the instant invention.

A preferred embodiment of the instant invention is illustrated in exploded isometric form in FIG. 1. The dual port burner 10 comprises a burner base 12 and a burner cap 14. The burner base typically comprises a plurality of gaseous fuel outlet ports 16 formed in an upper portion of the side walls 18. The upper wall of the gaseous fuel outlet ports 16 is formed once the cap 14 is positioned thereon. Alternatively, the plurality of gaseous fuel outlet ports 16 may be constructed in such a fashion in relation to the placement of the cap 14 to form a ribbon port around the entire periphery of the burner 10. Gaseous fuel is delivered to the burner base 12 through gaseous fuel inlet 20 which may be of conventional design incorporating mixture tube or in-shot gaseous fuel delivery.

In the embodiment of the instant invention illustrated in FIG. 1, the burner 10 also includes an inner chimney 22 formed on the burner base 12, and defining a passage 24 therethrough. This inner chimney 22, in conjunction with an inner chimney port feature 26 included on the cap 14, functions to form a plurality of gaseous fuel outlet ports 28 on an inner periphery ignition area within the circumference of the burner itself. The resulting dual port burner 10 is torres or donut-like shaped and produces cooking flames from both the inner and outer peripheries of the burner 10.

In order to provide ignition of the gaseous fuel flowing through both sets of ports 16, 28 in these two remotely situated ignition areas separated by the gaseous fuel plenum which is defined between the inner chimney 22, the side walls 18, and the cap 14, the instant invention contemplates the use of a primary electrode 30 placed within one of the two ignition areas. As may be seen from FIG. 1, electrode 30 is coupled by a high voltage supply wire 32 to an external source of high voltage electric power (not shown). Preferably, the high voltage source of electric power supplies the primary electrode 30 with a voltage of approximately 7,000 to 12,000 volts DC, although other voltages may be used as appropriate.

The embodiment illustrated in FIG. 1 places the primary electrode 30 within the inner periphery of the burner 10. An insulation means, such as ceramic insulator 34 or other appropriate insulation is utilized to prevent inadvertent spark generation between the primary electrode 30 and the burner base 12 or cap 14. Proper relationship of the primary electrode 30 within the inner periphery of the burner 10 is maintained by bracket 36 which is held in place by the bracket mounting screw 38 which mounts in piloted hole 40.

In this embodiment of the instant invention, a secondary electrode 42 is positioned to traverse the gaseous fuel plenum between the inner and outer peripheries of the dual port gas burner 10. This secondary electrode 42 has a first end 44 which is positioned in close proximity to the primary electrode 30 within the inner periphery, and a second end 46 which is positioned on the outer periphery of the burner 10 which, in this embodiment, is the second ignition area. As with the primary electrode 30, a means of electrical insulation, such as ceramic sleeve 48 is utilized with the secondary electrode 42 to prevent inadvertent spark generation between the secondary electrode 42 and the interior of the gaseous fuel plenum. As is typical when utilizing a form of electronic ignition, the burner base 12 is coupled to ground as indicated schematically by the ground connection 50.

Figure 2:
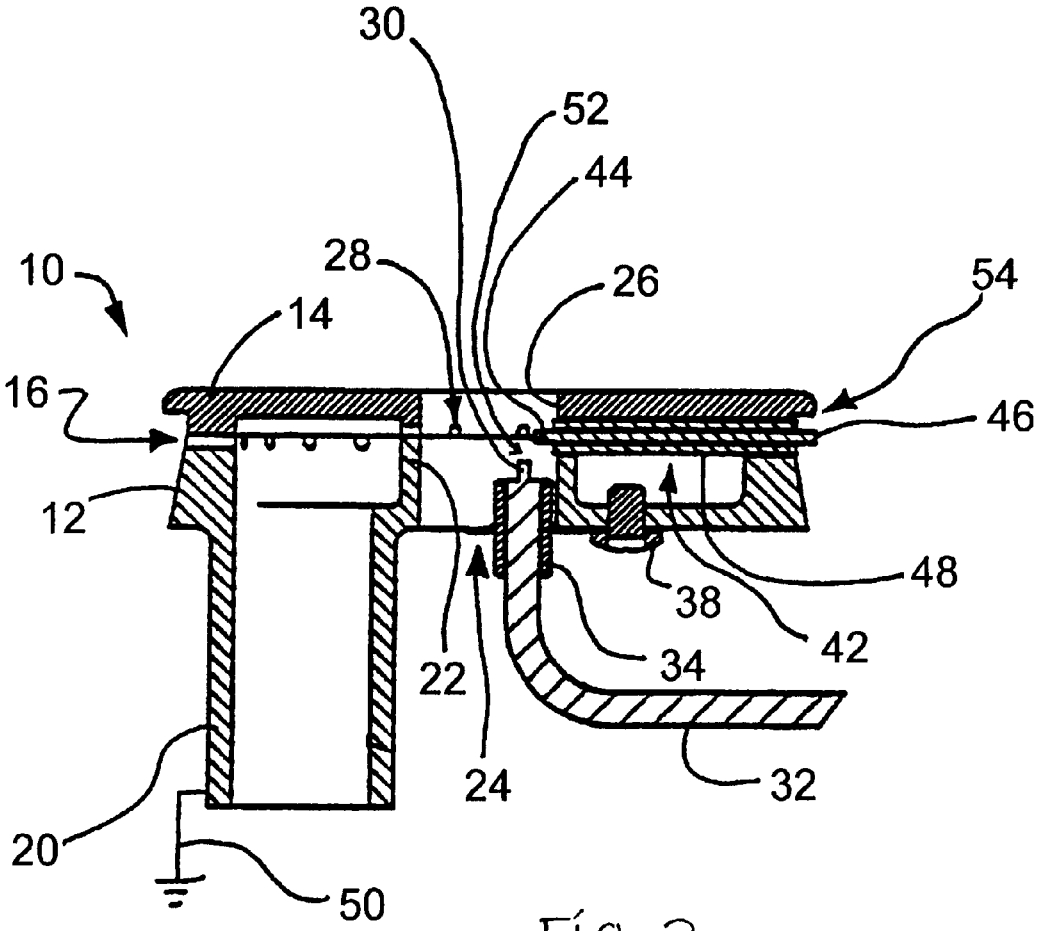
FIG. 2 is a cross-sectional schematic view of the embodiment of the instant invention illustrated in exploded isometric form in FIG. 1.

The relationship between the primary electrode 30 and the secondary electrode 42 is illustrated in greater detail in FIG. 2 to which reference is now made. As may be seen from this cross sectional illustration of this embodiment of the instant invention, the primary electrode 30 is positioned within the channel 24 in spaced relation from the wall 22 and in proximity to the orifices 28. The secondary electrode 42 is positioned to traverse the gaseous fuel plenum from the inner periphery to the outer periphery. The end 44 of the secondary electrode 42 is positioned in close proximity to the primary electrode 30 defining a jump gap 52 therebetween. This jump gap 52 is preferably smaller than a conventional spark gap, although it may be within the range of approximately 110±30 thousandths of an inch. The selection and placement of the insulators 34 and 48 prevent inadvertent spark generation between either the primary and secondary electrode and the burner base 12 or cap 14 within this inner periphery.

The second end 46 of secondary electrode 42 is positioned a second ignition area by the outer periphery of the burner 10, and is positioned in proximity to the burner, and preferably within proximity of the burner cap 14 forming a ground spark gap 54 therebetween. This ground spark gap is of conventional width to allow gaseous fuel ignition, and it may be within the range of approximately 110±30 thousandths of an inch. Once again, the selection and positioning of the insulator 48 prevents inadvertent spark discharge within the gaseous fuel plenum or any other non-intended region of the burner 10.

During operation, a user will turn on the burner by operating some sort of control valve to allow a flow of gaseous fuel thereto. This operation will also energize the dual point ignition circuit to allow ignition of the gaseous fuel entering both the inner periphery and outer periphery ignition areas. In this embodiment of the instant invention, a series electric circuit is formed between the external source of high voltage electric power, the primary electrode 30, the jump gap 52, the secondary electrode 42, the ground spark gap 54, and the burner cap 14 and base 12 which coupled to the system ground 50. When this series electric circuit is energized by the external source of high voltage electric power, a spark is generated nearly simultaneously at both the jump gap 52 and at the ground spark gap 54. Since this is a series electric circuit, the energy transferred in each spark by the current flow is also approximately identical for both the jump gap 52 and the ground spark gap 54, thereby ensuring reliable ignition of gaseous fuel flowing in both areas of ignition. This embodiment of the instant invention may be utilized with any form of control system for the sparking events including single, multiple, and controlled sparking controllers.

Figure 3:
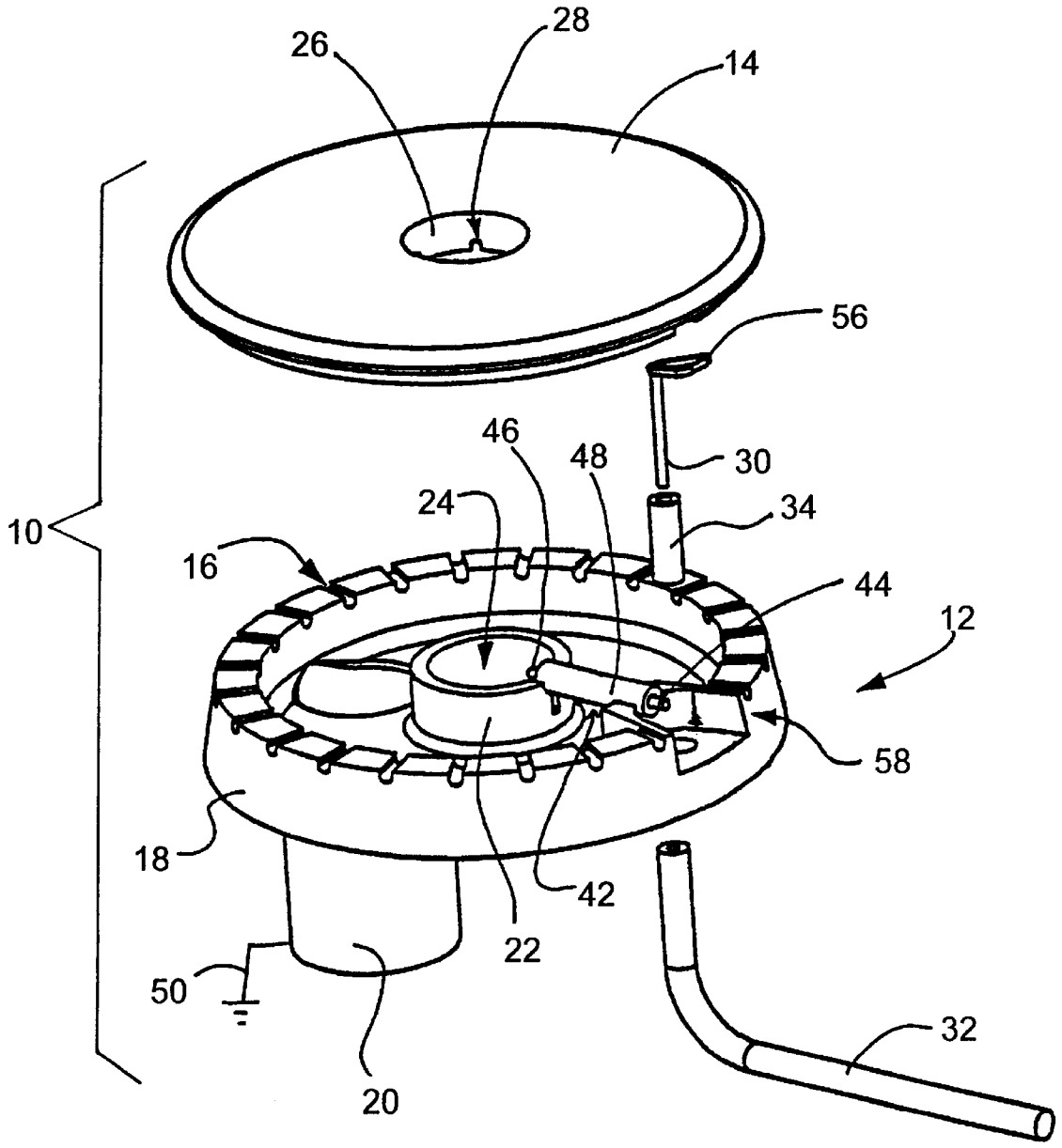
FIG. 3 is an exploded isometric view of an alternate embodiment of the instant invention.

An alternate embodiment of the instant invention is illustrated in FIG. 3, and specific reference is now made thereto. This embodiment of the instant invention utilizes, in conjunction with primary electrode 30, a conventional flame sense probe 56. The use of this flame sense probe 56 necessitates slight modification from the embodiment discussed above. Particularly, the primary electrode 30 is now placed in proximity to the outer periphery of the dual port burner in an ignition region 58 defined in the outer periphery of the burner 10. This modification allows the flame sense probe 56 to be properly positioned to sense the outer peripheral flames from the dual port burner, as is conventional.

Figure 4:
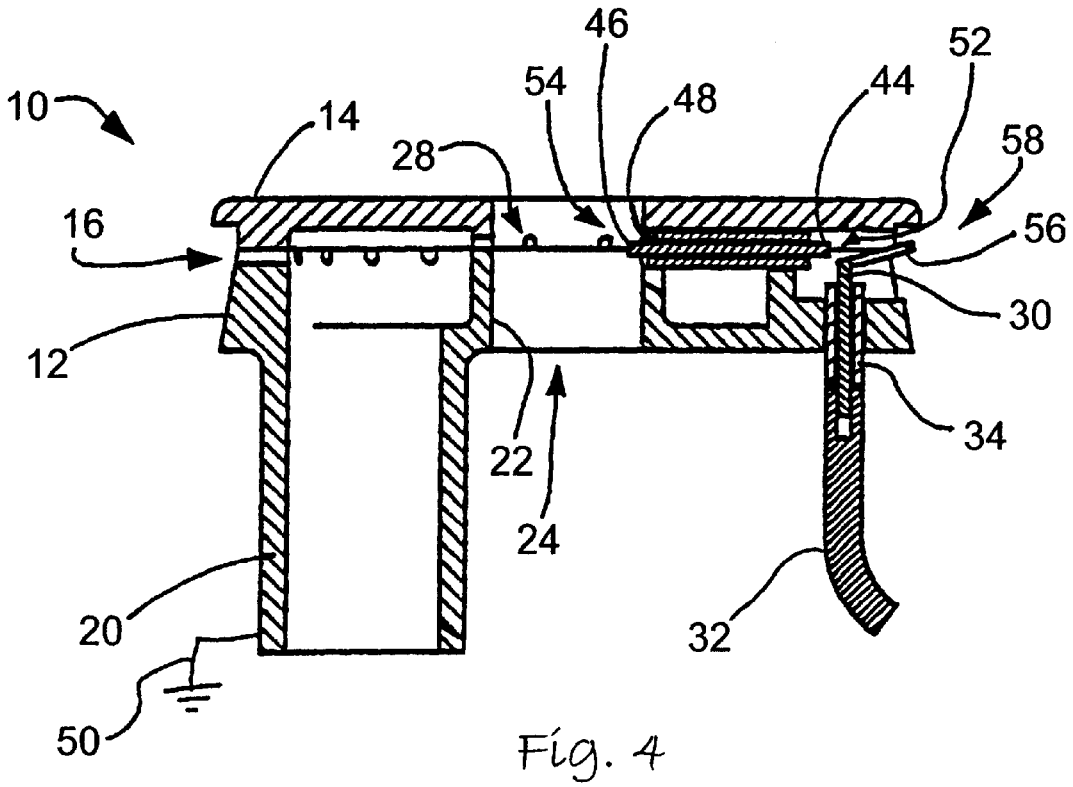
FIG. 4 is a cross-sectional schematic view of the alternate embodiment of the instant invention illustrated in exploded isometric form in FIG. 3.

In this embodiment of the instant invention, the jump gap 52 and the ground spark gap 54 are reversed, as may be seen from FIG. 4. Here, the jump gap 52 exists proximal to the outer periphery of the burner 10, while the ground spark gap 54 exists within the inner periphery. In this way, the gaseous fuel exiting the outer periphery of the burner 10 through ports 16 is ignited by the spark discharge in the jump gap between the primary electrode 30 and the first end 44 of the secondary electrode. The gaseous fuel entering the inner periphery through ports 28 is therefore ignited by the spark generated at the ground spark gap 54 between the second end 46 of the secondary electrode and the burner cap 14 and/or base 12. The flame is then sensed using conventional flame sensing probe 56 in conjunction with primary electrode 30 in a conventional manner. Once again, the primary insulation 34 and the secondary insulation 48 prevents inadvertent spark generation in regions other than the jump gap 52 and the ground spark gap 54.

Figure 5:
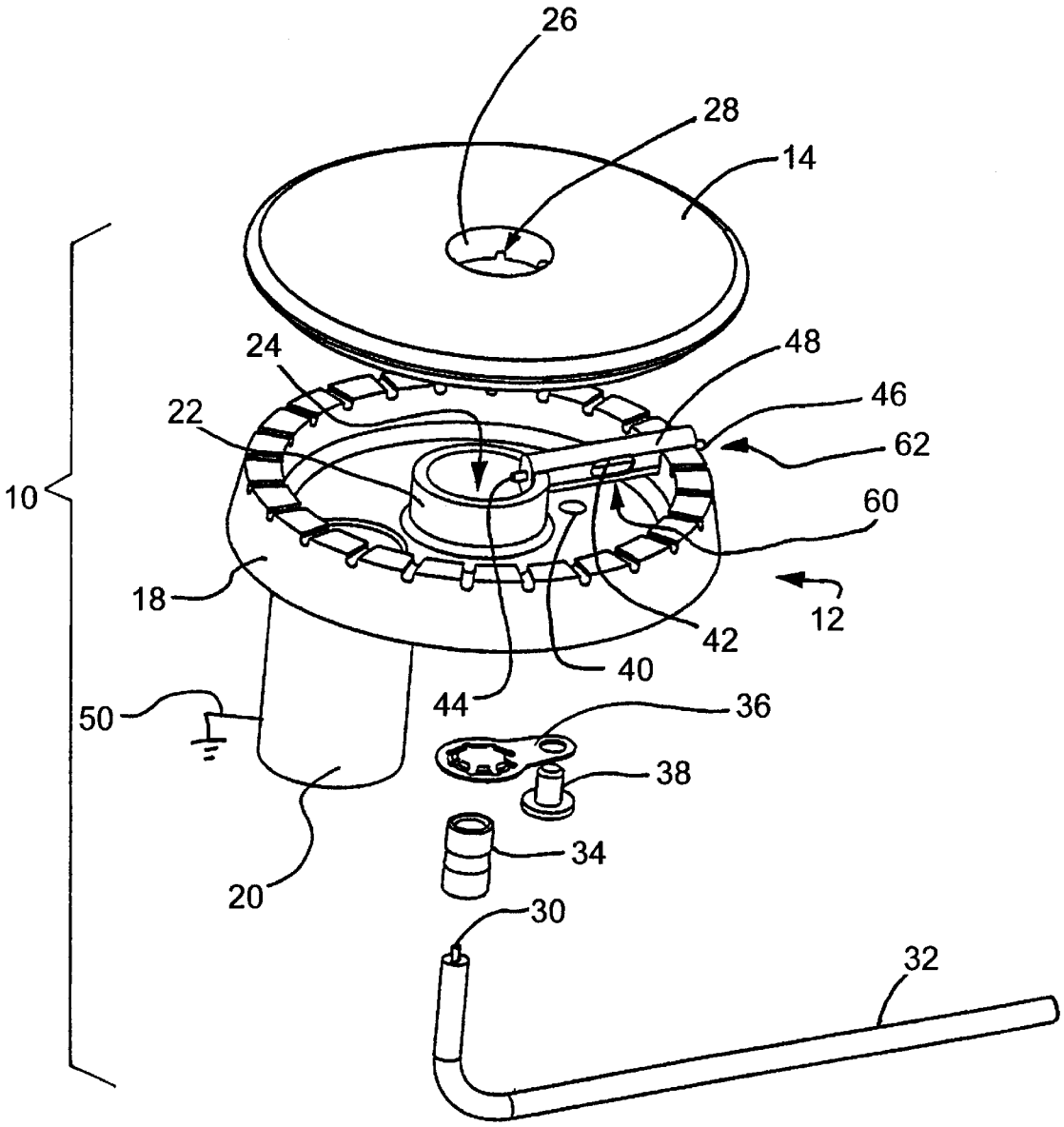
FIG. 5 is an exploded isometric view of a further alternate embodiment of the instant invention.

An alternate embodiment of the instant invention is illustrated in FIG. 5 with an electrode configuration similar to that illustrated in FIG. 1. In this embodiment, however, the secondary insulation 48 includes at least one gas entry port 60 which allows gaseous communication between a gas flow port 62 defined within the secondary insulation 48 and the gaseous fuel plenum. The gas entry port is positioned such that inadvertent spark generation within the gaseous fuel plenum is avoided.

Figure 6:
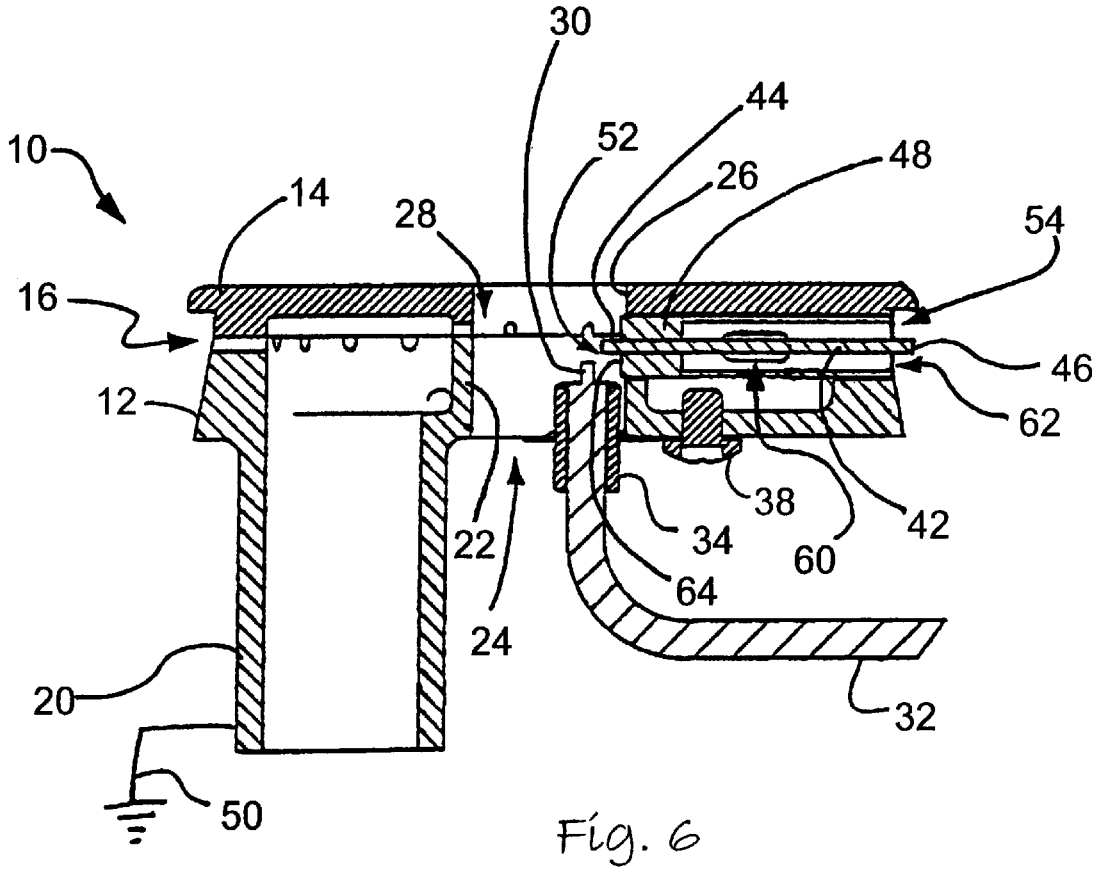
FIG. 6 is a cross-sectional schematic view of the further alternate embodiment of the instant invention illustrated in exploded isometric form in FIG. 5.

The details of the gas entry port 60 and the gas flow port are best understood with reference to FIG. 6 to which reference is now specifically made. As may be seen, the gas flow port 62 is defined within the secondary insulation 48 along its axial length. Preferably, the secondary electrode 42 is co-axially positioned within the gas flow port 62 so that ground spark generated between the end 46 and the cap 14 will arc through the gaseous fuel exiting the gas flow port 62. Gaseous fuel enters this gas flow port 62 through at least one gas entry port 60 defined in the outer wall of the secondary insulation 48. In this embodiment, the gas flow port allows the flow of gaseous fuel through the secondary insulation 48 where the secondary electrode 42 is positioned to control gaseous fuel flow around the secondary electrode 42 for improved gas ignition within a small area of the burner head on the circumference of the burner port wall within the ground spark gap 54. Advantageously, the spark created must arc through the gaseous fuel with minimum size and, therefore, improved ignition characteristics.

While the embodiment of the secondary insulation 48 illustrated in FIG. 6 includes a closed portion 64 in proximity to the jump gap 52, one skilled in the art will recognize that this end could be alternatively or additionally open to allow gaseous fuel exit. Additionally, on skilled in the art will recognize that the gas flow port 62 need not form a co-axial relationship with the secondary electrode 42, but may be take the form of a channel positioned so that gaseous fuel exits through the ground spark gap 54 while allowing the secondary insulation to completely enclose the secondary electrode 42, precluding the occurrence of inadvertent spark generation.

In accordance with the above teachings, a method of creating a dual point electric spark to ignite gaseous fuel at two separate ignition areas within a dual port gas burner for a gas range in accordance with the instant invention comprises the steps of: a) grounding the burner to an electrical system ground; b) forming a series electric circuit from a source of high voltage electric power to the burner, the series electric circuit passing through two separate ignition areas; c) providing a jump gap in the series electric circuit within one of the two separate ignition areas; d) providing a ground spark gap in the series electric circuit within the other of the two separate ignition areas; and e) energizing the series electric circuit.

Further in accordance with the teachings of the instant invention, the step of forming a series electric circuit comprises the steps of: f) providing a primary electrode within a first ignition area; g) providing a secondary electrode having a first end thereof in the first ignition area, and a second end in a second ignition area; h) positioning the first end of the secondary electrode in close proximity to the primary electrode creating a jump gap therebetween; and i) positioning the second end of the secondary electrode in proximity to the burner.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. The details of the structure may be varied substantially without departing from the spirit of the invention, and the exclusive use of all modifications which come within the scope of the appended claims is reserved.

What is claimed is:

1. An ignition apparatus for a single gaseous fuel burner head having a grounded housing and at least two areas of gaseous fuel discharge, comprising:

a primary electrode coupled to an external source of high voltage electric power, said primary electrode being positioned within a first area of gaseous fuel discharge; and a secondary electrode having a first end thereof positioned within the first area in close proximity to said primary electrode defining a jump gap therebetween, and a second end thereof positioned within a second area of gaseous fuel discharge in proximity to the single burner head forming a ground spark gap therebetween; and wherein at least one of said jump gap and said ground spark gap is positioned such that a flame resulting from ignition of the gaseous fuel crosses said at least one of said jump gap and said ground spark gap.

2. The ignition apparatus of claim 1, further comprising primary insulation operably coupled to said primary electrode, said primary insulation preventing inadvertent spark generation to the grounded burner housing.

3. The ignition apparatus of claim 1, further comprising secondary insulation operably coupled to said secondary electrode, said secondary insulation preventing inadvertent spark generation to the grounded burner housing.

4. An ignition apparatus for a gaseous fuel burner having a grounded housing and at least two areas of gaseous fuel discharge, comprising:

a primary electrode coupled to an external source of high voltage electric power, said primary electrode being positioned within a first area of gaseous fuel discharge;

a secondary electrode having a first end thereof positioned within the first area in close proximity to said primary electrode defining a jump gap therebetween, and a second end thereof positioned within a second area of gaseous fuel discharge in proximity to the burner forming a ground spark gap therebetween;

secondary insulation operably coupled to said secondary electrode, said secondary insulation preventing inadvertent spark generation to the grounded burner housing; and wherein said secondary insulation defines an axial gas flow port extending at least a portion of a length of said secondary insulation, and at least one gas entry port in gaseous communication with said gas flow port.

5. An ignition apparatus for a gaseous fuel burner having a grounded housing and at least two areas of gaseous fuel discharge, comprising:

a primary electrode coupled to an external source of high voltage electric power, said primary electrode being positioned within a first area of gaseous fuel discharge;

a secondary electrode having a first end thereof positioned within the first area in close proximity to said primary electrode defining a jump gap therebetween, and a second end thereof positioned within a second area of gaseous fuel discharge in proximity to the burner forming a ground spark gap therebetween; and wherein the burner is a dual port burner having an outer periphery ignition area and an inner periphery ignition area forming a torres shaped burner, the outer periphery ignition area and the inner periphery ignition area being separated by a gaseous fuel plenum from which gaseous fuel is delivered to the outer periphery ignition area and the inner periphery ignition area, wherein said secondary electrode penetrates through the gaseous fuel plenum, and wherein said secondary insulation further prevents inadvertent spark generation within the gaseous fuel plenum.

6. The ignition apparatus of claim 5, wherein said primary electrode is mounted within the inner periphery ignition area.

7. The ignition apparatus of claim 5, wherein said primary electrode is mounted within the outer periphery ignition area.

8. The ignition apparatus of claim 7, wherein said primary electrode includes a flame sense probe affixed thereto.

9. A burner assembly for a gas range, comprising:

a torres shaped burner base having an outer periphery and an inner periphery, said base electrically coupled to an external electrical system ground;

a torres shaped burner cap positioned in relation to said burner base to form a gaseous fuel plenum therebetween, and forming at least one orifice in said fuel plenum positioned to deliver gaseous fuel to said outer periphery and at least one orifice in said fuel plenum positioned to deliver gaseous fuel to said inner periphery;

a primary electrode coupled to an external source of high voltage electric power, said primary electrode being positioned within a first area of gaseous fuel discharge; and a secondary electrode having a first end thereof positioned within said first area in close proximity to said primary electrode defining a jump gap therebetween, and a second end thereof positioned within a second area of gaseous fuel discharge in proximity to said base and said cap forming a ground spark gap therebetween.

10. The burner of claim 9, further comprising primary insulation operably coupled to said primary electrode, said primary insulation preventing inadvertent spark generation to said base and to said cap.

11. The burner of claim 9, further comprising secondary insulation operably coupled to said secondary electrode, said secondary insulation preventing inadvertent spark generation to said base and to said cap.

12. The burner of claim 11, wherein said secondary electrode penetrates through said gaseous fuel plenum, and wherein said secondary insulation further prevents inadvertent spark generation within said gaseous fuel plenum.

13. The burner of claim 12, wherein said secondary insulation defines an axial gas flow port extending at least a portion of a length of said secondary insulation, and at least one gas entry port providing gaseous communication between said gas flow port and said gaseous fuel plenum.

14. The burner of claim 12, wherein said first area is defined within said inner periphery.

15. The burner of claim 12, wherein said first area is defined by said base and said cap in proximity to said outer periphery.

16. The burner of claim 15, wherein said primary electrode includes a flame sense probe adjoined thereto.

17. The burner of claim 9, wherein said primary electrode, said jump gap, said secondary electrode, said ground spark gap, and said base and said cap form a series electric circuit from the external source of high voltage electric power to the external electrical system ground resulting in approximately simultaneous generation of a first spark at said jump gap and of a second spark at said ground spark gap thereby resulting in ignition of gaseous fuel at said inner periphery and at said outer periphery.

18. A method of creating a dual point electric spark to ignite gaseous fuel at two separate ignition areas within a single dual port gas burner head for a gas range, comprising the steps of:

grounding the single dual port gas burner head to an electrical system ground;

forming a series electric circuit from a source of high voltage electric power to the burner, the series electric circuit passing through the two separate ignition areas;

providing a jump gap in the series electric circuit within one of the two separate ignition areas;

providing a ground spark gap in the series electric circuit within the other of the two separate ignition areas such that at least a portion of said ground spark gap is at least as high as a horizontal level of the other of the two separate ignition areas; and energizing the series electric circuit.

19. The method of claim 18, wherein the step of forming a series electric circuit comprises the steps of:

providing a primary electrode within a first ignition area;

providing a secondary electrode having a first end thereof in the first ignition area and a second end in a second ignition area;

positioning the first end of the secondary electrode in close proximity to the primary electrode creating a jump gap therebetween; and positioning the second end of the secondary electrode in proximity to the burner.

* * * * *